US005836455A

United States Patent [19]

Connor et al.

[11] Patent Number: 5,836,455

[45] Date of Patent: Nov. 17, 1998

[54] FLOOR DISPLAY ASSEMBLY

[75] Inventors: Wilton M. Connor, Charlotte, N.C.; Gregory R. Buchanan, Rock Hill; Daniel E. Hagood, Clover, both of S.C.

[73] Assignee: Eveready Battery Company, Inc., St. Louis, Mo.

[21] Appl. No.: 705,595

[22] Filed: Aug. 30, 1996

[51] Int. Cl.[6] ..... B65D 5/50

[52] U.S. Cl. ..... 206/757; 229/120.14; 229/120.15

[58] Field of Search ..... 206/561, 730, 206/734, 756, 757; 229/120.14, 120.15, 120.16, 120.24, 120.22

[56] References Cited

U.S. PATENT DOCUMENTS

| | | | |
|---|---|---|---|
| 3,606,004 | 9/1971 | Fruehwirth | 229/120.15 |
| 3,945,557 | 3/1976 | Graham, Jr. | 229/120.24 |
| 4,042,168 | 8/1977 | Kasel et al. | 229/120.16 |
| 4,089,457 | 5/1978 | Wood et al. | 229/120.24 |
| 4,095,735 | 6/1978 | Stone | 229/120.15 |
| 4,213,559 | 7/1980 | Meyers | 229/120.15 |
| 4,432,254 | 2/1984 | Bloom | 229/120.16 |
| 4,752,029 | 6/1988 | Buford | 229/120.24 |

*Primary Examiner*—David T. Fidei
*Attorney, Agent, or Firm*—Robert W. Welsh; S. Allan Fraser

[57] ABSTRACT

A display stand tray for displaying product for sale includes a bottom support panel to support the product for sale and a pair of upstanding end walls and a back wall integral with the bottom support panel for retaining the product in the display stand tray. The display stand tray has at least one divider tab, integral to and die-cut from the back wall, wherein the tab is movable from a first non-engageable position flush with the back wall to a second engaging position wherein the divider tab lies in a vertical plane substantially parallel to the end walls and positioned for separating rows of product on display.

20 Claims, 4 Drawing Sheets

FLOOR DISPLAY ASSEMBLY

BACKGROUND OF THE INVENTION

This invention relates to a floor display for sales of a product and particularly to a display to be placed in a store aisle for sale of batteries and the like.

Typical marketing of batteries involves shipment of cartons of batteries to a sales location e.g., a store, removal of the batteries from the shipping cartons, and placement of the batteries on a store shelf for display to customers. This results in at least two significant disadvantages. Firstly, labor is required to transfer the batteries from the shipping cartons to a display shelf. Secondly, valuable store shelf space is used.

Placing the batteries directly into a display tray which is also utilized as a shipping carton for use in the store is known in the art. One such prior art display tray is shown in FIG. 13 and shown generally at 220. Display tray 220 has upstanding end walls 226 and upstanding interior walls 222 which form rows 228 for the retention of product such as individual battery blister packs. The blister packs are prevented from spilling out of a front end of tray 220 by a front panel 224. A considerable number of these display trays could be placed in a stacked relationship for shipping. However, a problem which exists with the use of a display tray of this type is that the display trays were only adapted for fitting flat on a horizontal shelf or counter in a single tiered manner. If the store desired to stack the display trays 220 vertically, the display trays tended to conceal the product contained within the tray immediately below and also made access to the product difficult for the intended purchaser. Thus, there is a need to develop and provide stores with display trays which are sufficiently rigid and sturdy for shipment of the product, yet attractive and appealing to form point-of-purchase displays utilizing the display trays in a manner to promote intended purchaser accessibility and visibility.

Due to increased demands by different stores for specific display configurations, there exists a need for a display tray that is versatile for use in various configurations. Further, in the battery industry, there exists a need for a versatile display tray that can accommodate battery packs of various sizes.

SUMMARY OF THE INVENTION

An object of this invention is to provide a display stand and tray which can be utilized for handling and shipping batteries, have strength to support the heavy batteries because of the tray structure, and can be stacked in multiples without collapsing. The trays may be individually placed for display as on a shelf or counter, and can be placed directly in store aisles as a display structure for customers, with two, three, or other multiples of shelves.

Each tray has product retention end walls and a back wall, as well as optional interior structural walls wherein the walls are built, shaped, and dimensioned to support overlying trays stacked thereon during shipment. The walls are integral with a bottom support panel for retaining the product therein and the back wall has at least one divider tab integral to and die-cut from the back wall wherein the tab is movable from a first non-engageable position flush with the back wall to a second engaging position wherein the divider tab lies in a vertical plane substantially parallel to the end walls and positioned for separating rows of product on display. The display stand tray may be constructed from cardboard and the walls may be constructed of double layer cardboard.

A second divider tab can be located on the bottom support panel wherein the second divider tab is integral to and die-cut from the bottom support panel and is movable from a first non-engageable position flush with the bottom support panel to a second engaging position. In a second engaging position the second divider tab lies in a vertical plane substantially parallel with the end walls and is positioned for separating rows of product on display. Typically, the first divider tab and second divider tab will lie substantially in the same vertical plane.

The display stand tray can also include a support stand integral to and die-cut from the bottom support panel wherein the support stand is movable from a first non-engageable position flush with the bottom support panel to a second engaging position wherein the support stand projects downwardly to elevate a front edge of the bottom support panel above a rear edge of the bottom support panel. The support stand has a first end integral to the bottom support panel, and a second free end for engaging a slot in the bottom support panel such that when the free end of the support stand engages the slot, the support stand forms a V-shape wherein the apex of the V-shape is substantially parallel with the rear edge of the bottom support panel.

A stiffener panel can be positioned between layers of cardboard forming the bottom support panel wherein the slot for receiving the free end of the support stand is positioned in the stiffener panel. The stiffener panel can also have two slots for receiving the free end of the support stand wherein the slots are positioned in a manner to permit the installation of the stiffener panel in at least two orientations with respect to a given orientation of the display stand tray thereby facilitating tray assembly.

The support stand can also have recesses formed along the apex of the V-shape support stand configuration wherein the recesses are substantially in vertical alignment with the interior walls of the display stand tray. As the display stand trays are vertically stacked, the recesses of one display stand engage the upper edges of the interior structural walls of an underlying display stand tray for supporting a forward portion of the upper display stand tray.

Another aspect of the current invention is a aisle display structure for displaying product for sale in a self-supported multi-tiered display. The aisle display structure comprises one or more of the display stand trays as described above in combination with a support base. The support base includes at least one platform for supporting a display stand tray in a position elevated above the aisle surface and a lip positioned above the platform and projecting over the platform for cooperatively forming a slot for receiving the back wall of the tray. The slot being dimensioned to snugly receive the back wall. The platform supports approximately a rear half of the tray and the lip retains the back edge of the display stand tray to retain the tray in a cantilevered fashion. The front edge of the platform is typically elevated above a rear edge of the platform for angling the product more along the view line of a purchaser.

For multi-tiered displays, the support base also includes a ledge positioned above the lip to support a rear portion of another tray and a front portion of the other tray supported by a support stand as described above wherein the recesses in the V-shaped apex of the support stand engage the upper edge of the interior walls of the first display stand tray and wherein the other display stand tray is supported substantially parallel to the first display stand tray. Additional tiers may be added by positioning additional ledges and lips at vertical intervals to engage additional display stand trays.

An alternate aisle display structure is characterized by a support base including at least one platform for supporting a display stand tray in a position elevated above the aisle surface wherein a front edge of the platform is elevated above a rear edge of the platform for angling the display stand tray and the product contained therein more along the view line of a purchaser. The base also includes at least one cantilevered ledge positioned above the platform wherein the cantilevered ledge includes an upper ledge surface for supporting a rear portion of another display stand tray and a lower lip surface projecting over the platform to cooperatively form a slot for receiving the back wall of a first display stand tray, the slot dimensioned to snugly receive the back wall of the display stand tray. The platform and the cantilevered ledge supports approximately a rear half of the display stand trays. Additional cantilevered ledges may be vertically positioned one above the other to receive the desired number of display stand trays for the aisle display structure, each vertical pair of adjacent display stand trays being separated by one cantilevered ledge, and a top display stand tray is supported in its entirety by an upper ledge surface of a top cantilevered ledge.

These and other objects, advantages, and features of the invention will become apparent upon studying the following disclosure including the drawings.

DETAILED DESCRIPTION OF THE PREFERRED EMBODIMENT

Figure 1:
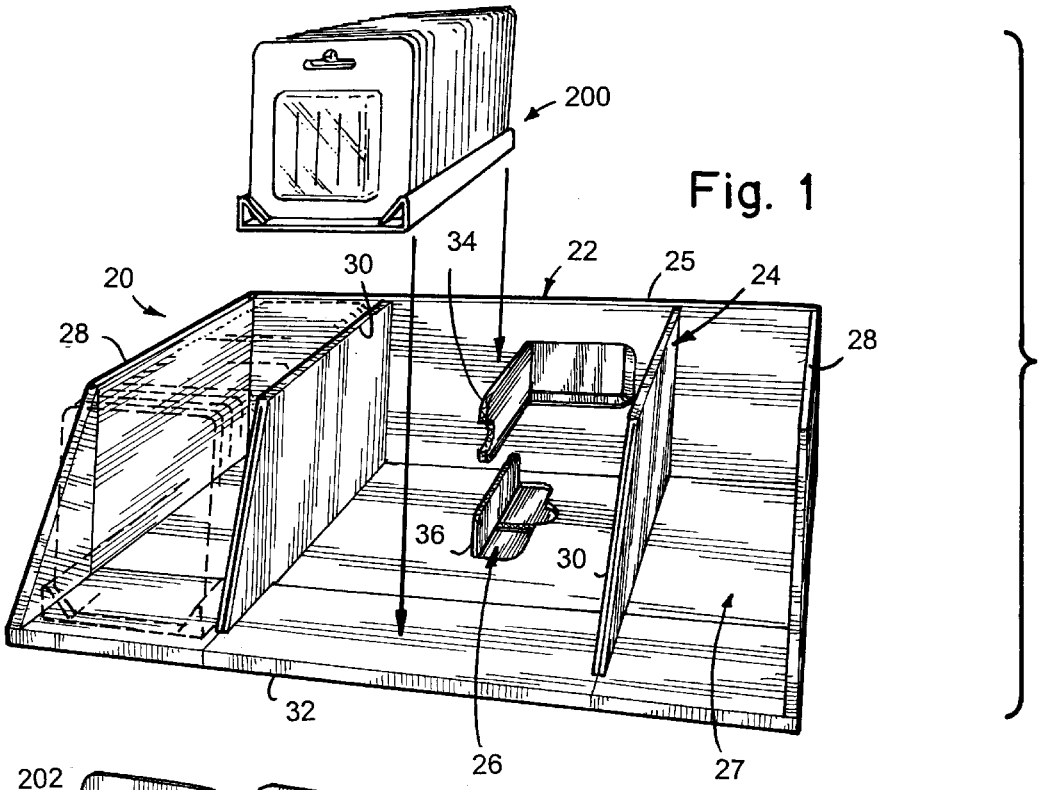
FIG. 1 is a perspective view of a display stand tray embodying the present invention, wherein blister pack trays are shown inserted in the display stand tray.
Figure 12:
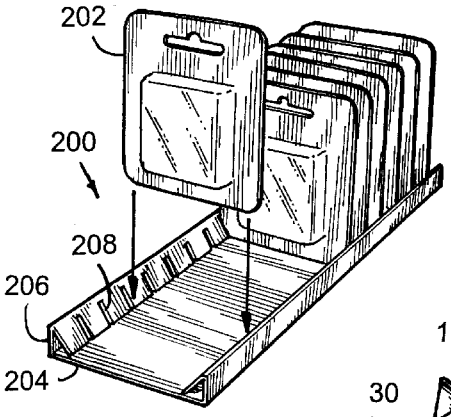
FIG. 12 is a blister pack tray showing the arrangement and retention of individual blister packs therein.
Figure 4:
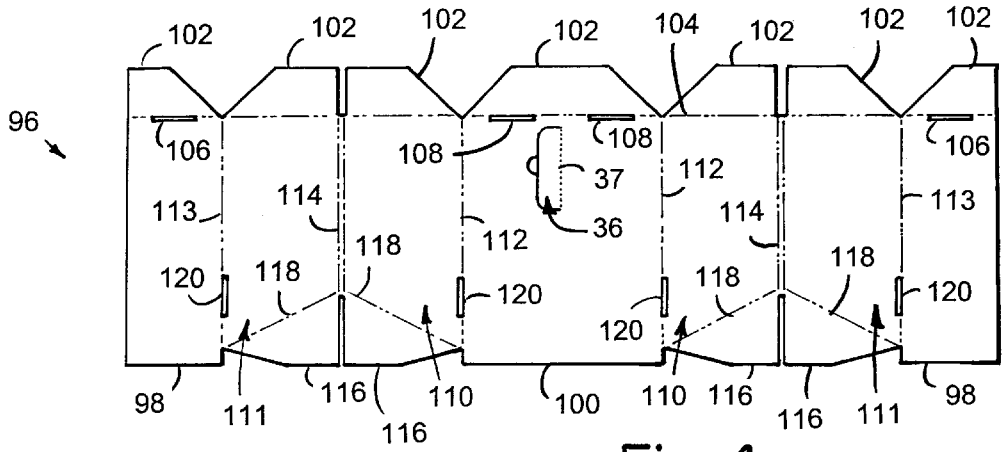
FIG. 4 is a die-cut blank of the inner divider member.
Figure 6:
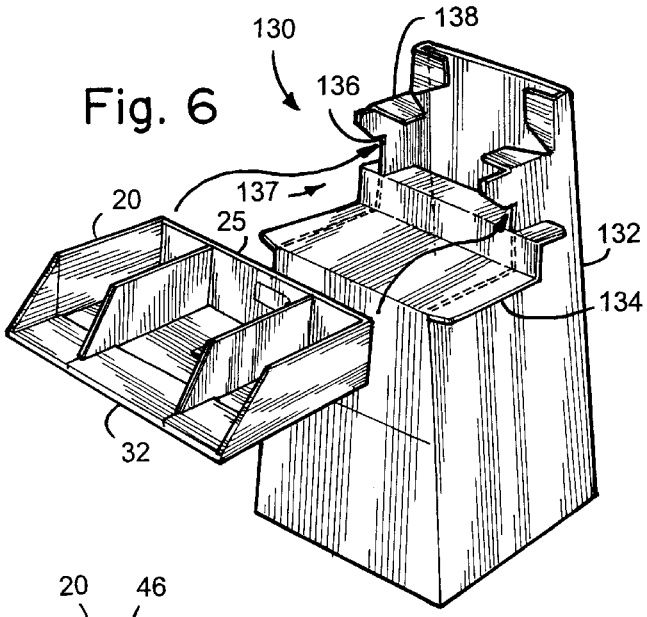
FIG. 6 is an exploded perspective view of a two-tiered aisle display structure.

For purposes of description herein, the terms "upper," "lower," "right," "left," "rear," "front," "vertical," "horizontal," and derivatives thereof shall relate to the invention as oriented in FIGS. 1 and 6 for the assembled display stand trays and aisle display structure and as oriented in FIG. 4 for the die-cut blanks. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Turning to the drawings, FIGS. 1–5 and 11 show a display stand tray 20, which is one of the preferred embodiments of the present invention, and illustrates its various components.

Figure 2:
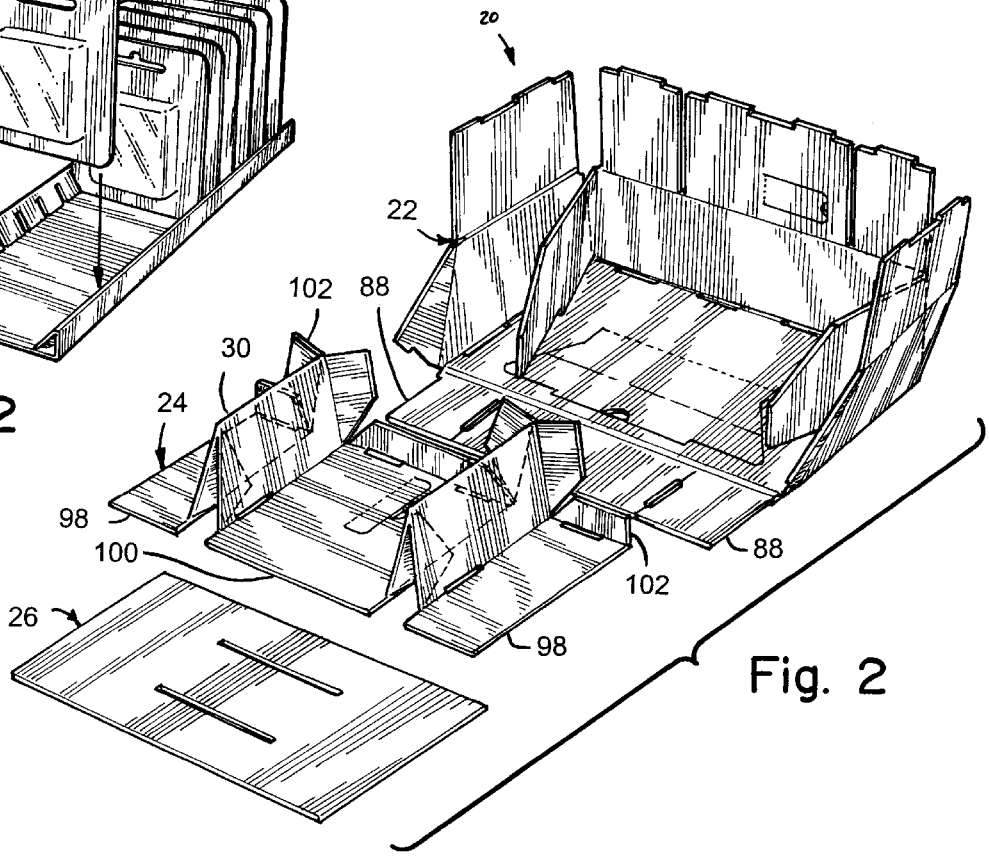
FIG. 2 is an exploded, perspective view of a display stand tray showing the die-cut blanks in a partially folded configuration.

Display stand tray 20, most easily seen in FIGS. 1 and 2, includes a folded outer shell member 22 which receives stiffener panel 26 and folded inner divider member 24 to form completed display stand tray 20. In its final assembled form, display stand tray 20 comprises bottom support panel 27, a pair of upstanding end walls 28 and a back wall 25 integral with bottom support panel 27. A pair of upstanding, interior structural walls 30 are positioned interior of end walls 28 and horizontally positioned therefrom to form channels therebetween. The channels being sized to receive the product for sale and for displaying the same, typically individual trays of blister or clam pack batteries, such as tray 200. Tray 200, which forms no part of the instant invention, typically comprises a bottom 204 with triangular support sides 206 having a series of laterally spaced apart slots 208 for receiving individual blister packs 202. Completed blister pack trays 200 are readily insertable and removable from the channels formed by upstanding walls 28 and 30. Display stand tray 20 typically has at least one pair of adjacent walls 28 or 30 which are positioned to receive at least two rows of product or blister pack trays 200 therebetween. At least one divider tab 34, integral to and die-cut from back wall 25 is movable from a first position flush with back wall 25 to a second position wherein divider tab 34 lies in a vertical plane parallel to walls 28 and 30. Divider tab 34 is positioned to separate blister pack trays 200 and to prevent product from shifting from one side to the other. A second divider tab 36 is integral to and die-cut from bottom support panel 27 and is movable from a first position flush with bottom support panel 27 to a vertical position wherein second tab 36 is substantially parallel with walls 28 and 30 and in substantially vertical alignment with divider tab 34. Because blister pack trays 200 for different sized batteries have different lengths, loose blister packs may be inserted between the end of the blister pack trays 200 and the back wall. Second divider tab 36 functions to prevent single blister packs 202 from laterally shifting within the lateral space described by interior support walls 30. Absent the divider tabs, smaller sized battery packs, such as four-packs of AAA sized batteries would shift between the inner two channels. By providing a combination of two divider tabs, a dividing mechanism may be provided that optionally extends well out inbetween the channels for one configuration and that may be conveniently moved into a flush position for another configuration.

In the preferred embodiment, display stand tray 20 is formed from corrugated cardboard, including outer shell member 22, inner divider member 24, and stiffener panel 26. However, it will be understood by those skilled in the art that the various members of display stand tray 20 may be formed of paperboard including cardboard and corrugated cardboard or any other substantially rigid yet foldable material.

Figure 11:
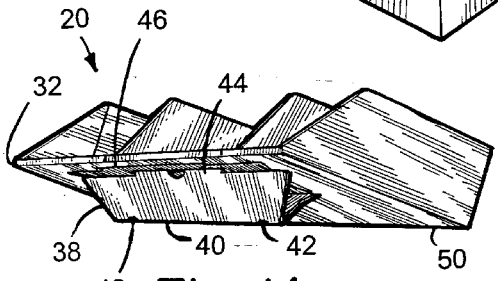
FIG. 11 is a bottom perspective view of a display stand tray showing the support stand in a deployed configuration.
Figure 8:
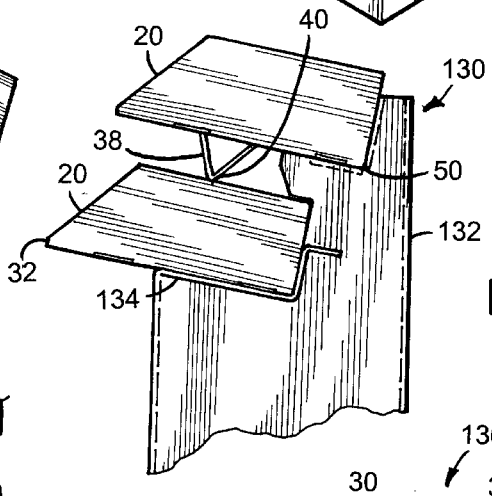
FIG. 8 is a side view of the two-tiered aisle display structure.
Figure 13:
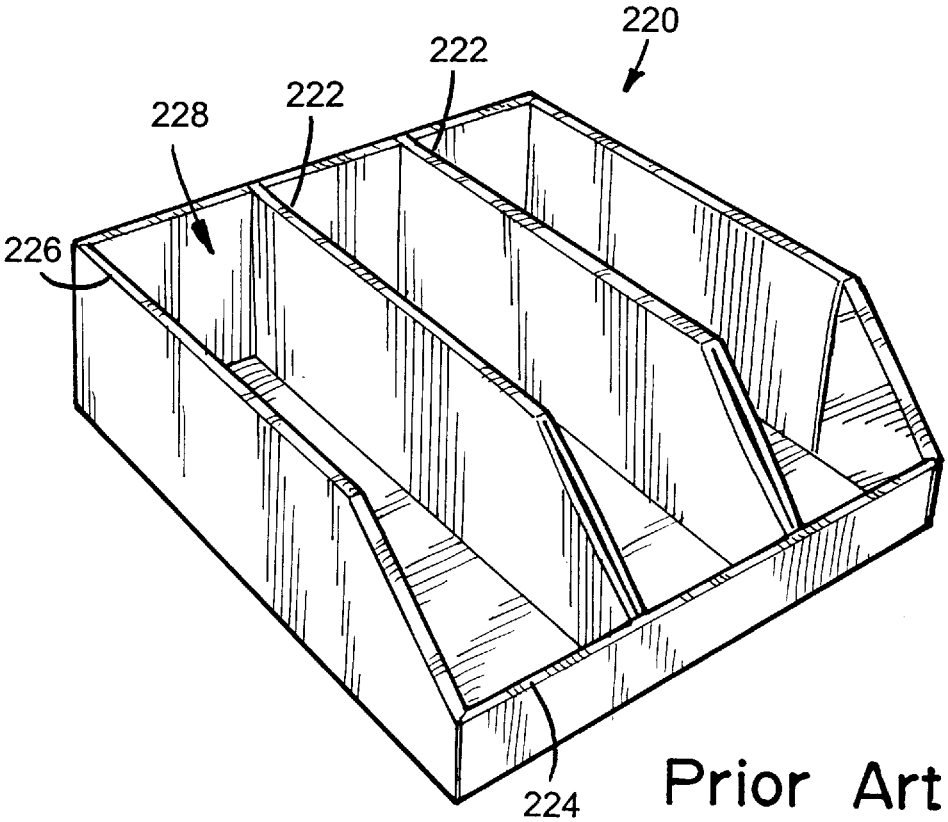
Prior Art Fig. 13
FIG. 13 is a perspective view of a prior art display stand tray.

Referring now to FIG. 11, display stand tray 20 is shown with a support stand 38 which is integral to and die-cut from the bottom support panel 27. Support stand 38 is movable from a first position flush with bottom support panel 27 to a second position wherein support stand 38 projects downwardly to elevate front edge 32 of bottom support panel 27 above the rear edge 50 of bottom support panel 27. When support stand 38 is in a deployed configuration, support stand 38 forms a V-shape wherein the apex 40 of the V-shape is parallel with rear edge 50 of bottom support panel 27. Apex 40 also has recesses 42 substantially in vertical alignment with interior structural walls 30 which engage the interior walls of a tray therebelow to minimize the possibility of lateral shifting between the two trays. Support stand 38 functions to support a front portion of display stand tray 20 in an elevated position above a rear portion of tray 20 thereby angling the channels containing the blister packed product more along the view line of a purchaser than if the display stand tray were placed on a horizontal surface in an unelevated position. Further, by angling the bottom surface back in the manner illustrated, the elevated front lip 224 of the prior art tray 220 (FIG. 13) may be eliminated since the battery packs are less likely to fall out of the tray. By eliminating front lip 224, which tends to obscure the customers' view of the products, one may provide a display tray that maximizes the visibility of the product. The use of divider tabs 34 and 36 rather than another full partition wall, also increases product visibility.

Figure 3:
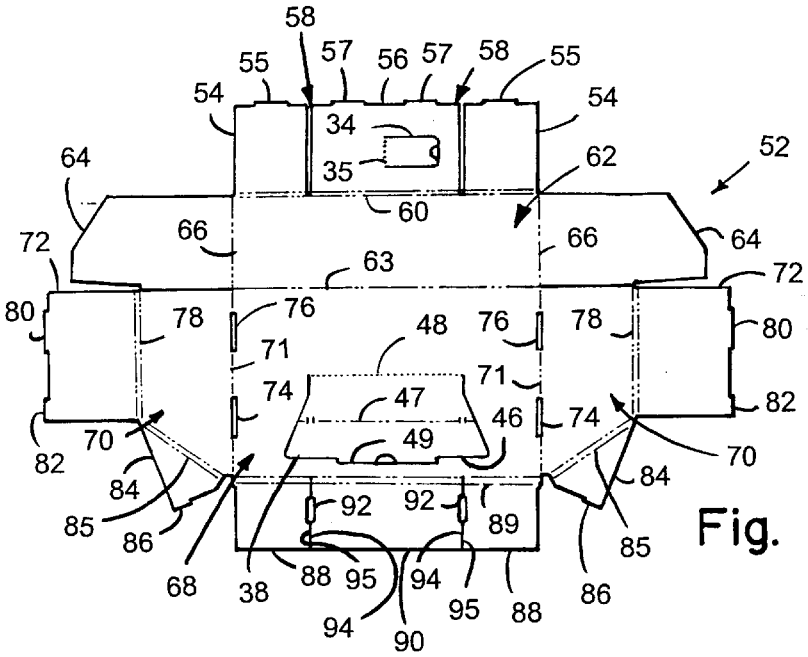
FIG. 3 is a die-cut blank of the outer shell member.

Turning now to FIG. 3, outer shell die-cut blank is shown generally at 52. Blank 52 includes a bottom panel 68, a rear panel 62, and two outer end panels 70. Panels 62 and 70 are joined to bottom panel 68 along fold lines 63 and 71, respectively. Joined to rear panel 62 are end panels 64. End panels 64 are joined to the left and right lateral ends of rear panel 62 along fold line 66. Also joined to rear panel 62 are outer back wall segments 54 and middle back wall segment 56. Back wall segments 54 and 56 are in lateral alignment and are joined to rear panel 62 along a top edge of rear panel 62 at fold line 60. Outer back wall segments have a tab 55 positioned along an upper edge of segment 54 opposite from fold line 60. Similarly, middle back wall segment has two tabs 57 positioned along an upper edge opposite fold line 60. Divider tab 34 is die-cut in an intermediate interior portion of middle back wall segment 56. Divider tab 34 is generally rectangular in shape and cut along three of the four sides of tab 34. The fourth side being joined to middle back wall segment 56 at fold line 35. Fold line 35 is positioned approximately midway between the lateral ends of middle back wall segment 56. Outer back wall segments 54 are laterally spaced from middle back wall segment 56 thereby forming slots 58 between segments 54 and 56. The width of slot 58 is approximately the thickness of interior structural wall 30 and in alignment therewith.

Joined to outer end panels 70 are inner end panel 72 and inner triangular panels 84. Inner end panel 72 is joined to outer end panel 70 at fold line 78 and inner triangular panel 84 is joined to outer end panel 70 at angled fold line 85. Inner end panels 72 have tabs 80 and 82 positioned at the outer lateral edges thereof and inner triangular panel 84 has tab 86 positioned at a lower outer edge thereof. Angle fold line 85 and inner triangular panel 84 are dimensioned such that when folded in a final assembled configuration as shown in FIG. 1, tray 20 possesses end walls 28 having forward edges which are clearly and uniformly angled away from a potential purchaser and wherein inner end panel 70 is in an end-to-end abutting relationship with triangular panel 84.

Outer front segments 88 and inner front segment 90 are joined to bottom panel 68 at a bottom edge thereof at fold line 89. Segments 88 and 90 are separate at cut line 94 with apertures 92 positioned therealong thereby forming tabs 95 at the inner lateral edges of segments 88 and the outer lateral edges of segment 90.

Positioned in an interior intermediate portion of bottom panel 68 is support stand 38. Support stand 38 is generally trapezoidal in shape with the major base being positioned most proximate to the lower edge of bottom panel 68 and the minor base being positioned approximately mid-height of bottom panel 68. Support stand 38 is die-cut around three sides of the trapezoidal shape with support stand 38 being joined to bottom panel 68 at fold line 48 which corresponds to the minor base of the trapezoid. Support stand 38 when disengaged from bottom panel 68 has free end 46 with support stand tab 49 positioned intermediate therealong. Fold line 47 is positioned parallel to and intermediate between free end 46 and fold line 48. Bottom panel 68 has positioned at its outer lateral edges thereof and along fold line 71, front slots 74, and rear slots 76. Slots 74 and 76 being vertically aligned with tabs 80 and 82 on inner end panels 72.

It will be noted by those skilled in the art, that fold lines 60, 78, 85, and 89 in FIG. 3 and fold line 114 in FIG. 4 are double fold lines which, when the various die-cut blanks are folded therealong, form a uniform plate-like appearance to elements of the final assembled tray which are folded 180 degrees into a self-abutting relationship.

Turning now to FIG. 4, inner divider die-cut blank is shown generally at 96. Blank 96 includes an inner support panel 100, interior wall panels 110 and 111, and outer support panels 98. One of each interior wall panels 110 are joined to each of the lateral edges of inner support panel 100 along bend line 112, and one of each of interior wall panel 111 is joined to the interior wall panels 110 in a mirror image fashion along fold line 114. Outer support panels 98 are joined to the outer lateral edge of interior wall panels 111 at fold lines 113. Rear flaps 102 are joined to outer support panels 98, inner support panel 100, and interior wall panels 110 and 111 at their respective upper edges thereof at fold line 104. Slots 106 project through outer support panels 98 along fold line 104 and are substantially laterally centered along the width of outer support panels 98. Two slots 108 also project through inner support panel 100 at an upper edge thereof along fold line 104. Slots 108 being intermediately spaced between the lateral edges of inner support panel 100. Front flaps 116 are joined to interior wall panels 110 at a bottom portion thereof along angled fold line 118. The angle of fold line 118 and the geometry of front flap 116 is such that when display stand tray 20 is finally assembled, interior support wall 30 as shown in FIG. 1 formed by interior wall panels 110 has a forward edge which is substantially parallel to the angled forward edge of end walls 28.

Figure 5:
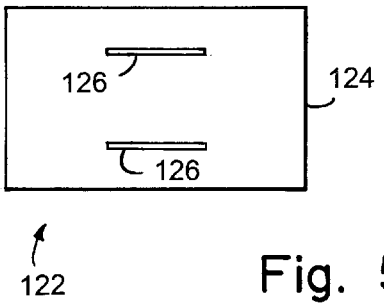
FIG. 5 is a die-cut blank of the stiffener panel.

FIG. 5 shows stiffener panel die-cut blank designated generally at 122. Blank 122 generally comprises panel 124 which is typically of a thick corrugated cardboard to provide additional support and strength to bottom support panel 27 thereby aiding in the shipping and stacking of filled display trays 20 with blister pack trays 200. Two slots 126 parallel to and each equi-distant from a corresponding adjacent major base of rectangular panel 124 project through panel 124 such that blank 122 is symmetrical about a vertical central axis and about a horizontal central axis thereby forming stiffener panel 26 as shown in FIG. 2. With reference to FIGS. 1 and 2 the symmetry of panel 26 facilitates ease of assembly of display stand tray 20 in that panel 26 may be inserted into outer shell member 22 in either of two orientations without affecting the functionality of display stand tray 20.

With reference to FIGS. 2–5 to assemble display tray 20, outer shell die-cut blank 52 is folded to form outer shell member 22. End panels 64 are folded up approximately 90 degrees along fold line 66 and rear panel 62 is then folded up 90 degrees with respect to bottom panel 68 along fold line 63. Outer end panels 70 are folded up approximately 90 degrees with respect to bottom panel 68 such that end panels 64 are interior to and in an abutting relationship with outer end panels 70. Inner end panels 72 are then folded down approximately 180 degrees along double fold line 78 until tabs 80 and 82 are engaged in slots 76 and 74, respectively. Inner triangular panels 84 are folded inwardly along double fold line 85 until partial tabs 86 are also engaged in slots 74.

Stiffener panel die-cut blank 122 (stiffener panel 26) is placed interiorly of partially assembled outer shell member 22 to rest on an upper surface of bottom panel 68. Slots 126 being parallel to fold line 89 of die-cut blank 52.

Turning now to inner divider die-cut blank 96, rear flaps 102 are folded up approximately 90 degrees along fold line 104. Front flaps 116 at the lower end of interior wall panels 110 are folded down and back 180 degrees along fold line 118. Interior wall panels 110 joined to inner support panel 100 are folded up 90 degrees along fold lines 112, and outer interior wall panels 111 are folded down 180 degrees along double fold lines 114. Inner and outer interior wall panels 110 and 111 combine when abutted after folding to form interior structural walls 30. Outer support panels 98 are folded up 90 degrees along fold line 113 to complete the forming of inner divider member 24 as shown in FIG. 2.

Folded inner divider member 24 is placed interiorly of partially folded outer shell member 22 such that rear flaps 102 abut rear panel 62, and outer and inner support panels 98 and 100 rest on an upper surface of stiffener panel 26. Outer and middle back wall segments 54 and 56 of outer shell member 22 are folded down 180 degrees along double fold line 60 until tabs 55 and 57 are captured and retained by slots 106 and 108 respectively in inner divider member 24. Outer and middle front segments 88 and 90 of outer shell member 22 are folded up and back along double bend line 89 until tabs 95 are captured and retained by slots 120 in inner divider member 24; thus, producing finished display stand tray 20. By folding front segments 88 and 90 over the front edge of the tray, additional reinforcement is provided at the front of the tray to prevent racking.

Divider tab 34 can be disengaged from its flush position in back wall 25 and bent forwardly 90 degrees along fold line 35 to position divider tab 34 to effect separation of individual blister packs 202. Similarly, second divider tab 36 may be disengaged from its flush position in bottom support panel 27 and folded up 90 degrees along fold line 37 to promote separation of individual blister packs 202.

Display stand trays 20 may be utilized with support stand 38 in either an engaged or non-engaged position. In its non-engaged position support stand 38 remains flush with the lower surface of bottom support panel 27. To deploy support stand 38, support stand free end 46 is disengaged from the lower surface of bottom support panel 27 and bent down approximately 45 degrees along fold line 48 and then folded up approximately 90 degrees along fold line 47. Removal of support stand 38 from its flush position exposes slot 126 in stiffener panel 26 so that it may receive tab 49 of support stand 38. Insertion of tab 49 in slot 126 retains support stand 38 in an engaged position for supporting a forward portion of display stand tray 20.

In use, display stand tray may be used singularly for displaying product on any horizontal shelf or counter top whereby display stand 38 may be utilized to elevate front edge 32 of display stand tray 20 above rear edge 50 for angling the product more along the view line of a purchaser.

Alternatively, multiple display stand trays 20 may be arranged in a vertically stacked relationship in cooperation with a support base to form a self-supporting aisle display structure such as those shown in FIGS. 6–10.

FIG. 6 discloses a two-tier aisle display structure shown generally at 130. Display stand structure 130 generally comprises support base 132 and two display stand trays 20, although it will be understood by those skilled in the art that an aisle display structure may also be constructed in like manner having three or more tiers. Support base 132 has a platform 134 elevated above the aisle surface for supporting a first display stand tray 20 thereon. One or more lips 136 are positioned above platform 134 and project over platform 134 for cooperatively forming slot 137 to receive back wall 25 of tray 20. Slot 137 is dimensioned to snugly receive back wall 25 thereby preventing tray 20 from being tipped off platform 134 by an unexpected force applied to front edge 32 of tray 20. Platform 134 generally supports a rear half of tray 20 thereby retaining tray 20 in a cantilevered fashion to promote the appearance of ready product accessibility to the purchaser. Further, a front edge of platform 134 is elevated above a rear edge of platform 134 for angling the product more along the view line of a purchaser.

A ledge 138 is positioned above lip 136 on support base 132 to support rear edge 50 of an upper display stand tray 20 vertically above a lower display stand tray 20 supported by platform 134. Ledge 138 supports a rear portion of the upper display stand tray 20. Upper display stand tray 20 has support stand 38 engaged in a manner as described above wherein recesses 42 in apex 40 of support stand 38 engage interior structural walls 30 of lower display stand tray 20 immediately below which thereby supports a forward portion of the upper display stand tray 20 in this manner. The cooperative stacking of display stand trays 20 is readily shown in FIGS. 7 and 8.

Figure 9:
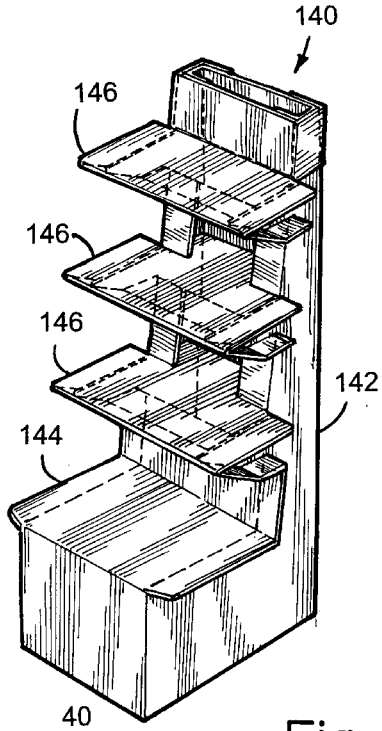
FIG. 9 is a perspective view of the support base of a four-tiered aisle display structure.
Figure 10:
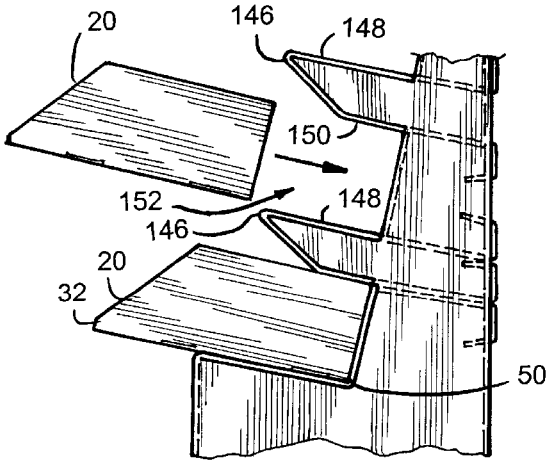
FIG. 10 is a partial side view of the four-tiered aisle display structure showing the cantilevered ledges and retention of the display stand trays therein.
Figure 7:
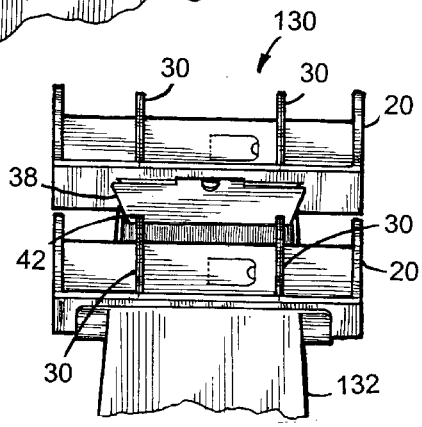
FIG. 7 is a front view of the two-tiered aisle display structure showing the engagement of the support stand of the top display stand tray engaging the interior walls of the lower display stand tray.

FIG. 9 and 10 illustrate an alternate configuration aisle display structure shown generally at 140 in a four-tier configuration, although, those skilled in the art will recognize that the aisle display structure 140 may be altered to provide any number of tiers.

Aisle display structure 140 generally comprises a plurality of display stand trays 20 which are supported by support base 142. Support base 142 has at least one platform 144 for supporting a lower display stand tray 20 in a position elevated above the aisle surface. Depending on the desired number of tiers in the aisle display structure, a series of cantilevered ledges 146 are positioned above platform 144 in a generally vertically aligned manner. Each cantilevered ledge 146 comprises an upper ledge surface 148 for supporting a rear portion of display stand trays 20 and a lower lip surface 150 projecting over platform 144 or another cantilevered ledge 146 to cooperatively form a slot 152 for receiving back wall 25 of display stand tray 20. Slot 152 is dimensioned to snugly receive back wall 25 of display stand tray 20 thereby preventing trays 20 from being tipped by an overbalancing force applied to front edge 32. Display stand trays 20 are completely supported by cantilevered ledges 146 and platform 144 without the need to employ support stand 38 for additional support of the forward edge 32 of display stand tray. Platform 144 and upper ledge surfaces 148 are angled such that front edges 32 of display trays 20 are elevated above rear edges 50 for angling display stand trays 20 and the product contained therein more along the view of a purchaser. The top most display stand tray 20 is typically supported in its entirety by the upper ledge surface 148 of the top most cantilevered ledge 146 although a lip such as lip 136 on support base 132 in FIG. 6 may be employed to provide additional support for upper most display stand tray 20.

Display tray 20 is preferably constructed to have a front width of approximately 16 inches, an outside depth from front to back of approximately 10 inches and height of approximately 4 ⅞ inches. The width of the channels between end walls 28 and interior walls 30 is approximately 3 ¾ inches to accommodate the standard size for standard size display cards containing batteries. Because many stores have placed constraints on the overall allowable width of a floor display of approximately 30 to 36 inches, for example, and because pallets typically used to transport batteries and other products are typically 48 inches by 40 inches, the 16 inch width of display tray 20 is preferred to allow two display trays to be used side by side within the store's constraints, while allowing the display trays to be stacked on a pallet three across by four deep without having any of the display trays overhanging an edge of the pallet to thereby prevent the display trays from becoming scratched or damaged. Because of these constraints on the outer dimensions of display tray 20 and because of the standard width of standard size display cards containing batteries, it was found that the use of divider tabs 34 and 36 was preferable to using a thicker more permanent inner wall between the inner two channels. If a permanent inner wall were to be used between the inner two channels, its thickness would require an undesirable increase in the width of the display trays or would require that a thinner less durable corrugated cardboard be utilized in making display tray 20. Although the above dimensions are preferred for the reasons stated above, it will be appreciated by those skilled in the art, that a display tray having the above dimensions is but one preferred embodiment of the present invention and that various combinations of the novel concepts described above may be utilized while using dimensions different from those stated above.

The aisle display structure and display trays described above may be formed entirely of corrugated cardboard without requiring any additional pieces, clamps, or clips of any other material. Thus, the entire structure may be recycled.

In the foregoing description, it will be readily appreciated by those skilled in the art that modifications may be made to the invention without departing from the concepts disclosed herein. Such modifications are to considered as included in the followings claims, unless these claims expressly state otherwise.

The embodiments of the invention in which an exclusive property or privilege is claimed are defined as follows:

1. A display stand tray for displaying product for sale, said display stand tray comprising:

a bottom support panel to support the product for sale;

a pair of upstanding end walls and a back wall, said walls integral with said bottom support panel, for retaining the product therein; and at least one divider tab, integral to and die-cut from said back wall, said tab being alternatively respositionable between a first non-engageable position flush with said back wall and a second engaging position wherein said divider tab lies in a vertical plane substantially parallel to said end walls and positioned for separating rows of product on display.

2. The display stand tray according to claim 1, wherein said tray, including said walls and said tab, are of paperboard.

3. The display stand tray according to claim 2, wherein said walls are of two layer paperboard.

4. The display stand tray according to claim 3, further comprising a pair of structural walls interior of said end walls.

5. The display stand tray according to claim 4, wherein at least one pair of adjacent ones of said interior or end walls are positioned to receive at least two rows of product therebetween and said divider tab is positioned between said walls to divide the rows of product.

6. A display stand tray for displaying product for sale, said display stand tray comprising:

a bottom support panel to support the product for sale;

a pair of upstanding end walls and a back wall, said walls integral with said bottom support panel, for retaining the product therein; and at least one divider tab, integral to and die-cut from said back wall, said tab being movable from a first non-engageable position flush with said back wall to a second engaging position wherein said divider tab lies in a vertical plane substantially parallel to said end walls and positioned for separating rows of product on display; and a second divider tab integral to and die-cut from said bottom support panel, said second tab being movable from a first non-engageable position flush with said bottom support panel to a second engaging position wherein said second tab lies in a vertical plane substantially parallel with said end walls and positioned for separating rows of product on display.

7. The display stand tray according to claim 6, wherein said tray, including said walls and said tabs, are of paperboard.

8. The display stand tray according to claim 7, wherein said walls are of double layer paperboard.

9. The display stand tray according to claim 8, further comprising a pair of structural walls interior of said end walls.

10. The display stand tray according to claim 9, wherein at least one pair of adjacent ones of said interior or end walls are positioned to receive at least two rows of product therebetween and said divider tabs are substantially co-planar and positioned between said walls to divide the rows of product.

11. A display stand tray for displaying product for sale, said display stand tray comprising:

a bottom support panel to support the product for sale, said bottom support panel includes a front edge and a rear edge, and further comprising a support stand integral to and die-cut from said bottom support panel, said support stand movable from a first non-engageable position flush with said bottom support panel to a second engaging position wherein said support stand projects downwardly to elevate said front edge of said bottom support panel above said rear edge of said bottom support panels;

a pair of upstanding end walls and a back wall, said walls integral with said bottom support panel, for retaining the product therein; and at least one divider tab, integral to and die-cut from said back wall, said tab being movable from a first non-engageable position flush with said back wall to a second engaging position wherein said divider tab lies in a vertical plane substantially parallel to said end walls and positioned for separating rows of product on display.

12. The display stand tray according to claim 11, wherein said tray, including said walls, said tab, and said support stand, are of paperboard.

13. The display stand tray according to claim 12, wherein said bottom support panel has a slot therein, said support stand has a first end integral to said bottom support panel, and a second free end for engaging said slot in said bottom support panel such that when said second free end engages said slot, said support stand forms a V-shape wherein the apex of said V-shape is substantially parallel with said rear edge of said bottom support panel.

14. The display stand tray according to claim 13, wherein said walls and said bottom support panel are of double layer paperboard.

15. The display stand tray according to claim 14, wherein said bottom support panel further comprises a stiffener panel positioned between said layers of said bottom support panel.

16. The display stand tray according to claim 15, wherein said stiffener panel has at least two of said slots for receiving said free end of said support stand.

17. The display stand tray according to claim 16, wherein said stiffener panel has said slots positioned in a manner to permit installation of said stiffener panel in at least two orientations with respect to a given orientation of said tray.

18. The display stand tray according to claim 17, further comprising a pair of structural walls interior of said end walls.

19. The display stand tray according to claim 18, wherein said apex of said V-shape has at least two recesses formed therealong.

20. The display stand tray according to claim 19, wherein said recesses are substantially in vertical alignment with said interior walls.

* * * * *